United States Patent [19]

Yoshio

[11] Patent Number: 4,650,105

[45] Date of Patent: Mar. 17, 1987

[54] MINI-STAPLER

[76] Inventor: Kihara Yoshio, 1334-22, Haematsu, Kawaguchi-Shi, Saitama-Ken, Japan

[21] Appl. No.: 699,065

[22] Filed: Feb. 7, 1985

[30] Foreign Application Priority Data

Sep. 8, 1984 [JP] Japan ..... 59-188732

[51] Int. Cl.[4] ..... B25C 5/02; B25C 5/11

[52] U.S. Cl. ..... 227/120; 227/125

[58] Field of Search ..... 227/120, 125–128

[56] References Cited

U.S. PATENT DOCUMENTS

| | | | |
|---|---|---|---|
| 2,309,763 | 2/1943 | Goodstein | 227/126 |
| 3,144,653 | 8/1964 | Kohen | 227/128 |
| 4,524,896 | 6/1985 | Morrell, Jr. | 227/128 X |

FOREIGN PATENT DOCUMENTS

| | | | |
|---|---|---|---|
| 1151243 | 7/1963 | Fed. Rep. of Germany | 227/128 |
| 0647179 | 12/1950 | United Kingdom | 227/128 |

*Primary Examiner*—Mark Rosenbaum
*Assistant Examiner*—Taylor J. Ross
*Attorney, Agent, or Firm*—Fred Philpitt

[57] ABSTRACT

A guide rail is provided along the length of the inside of a channel shaped frame which staples are loaded in. A staple pushing member, namely, a slider is provided which can move on this guide rail. One end of a tension coil spring is fitted to one side of the guide rail on the inside of the frame, the tension coil spring is brought around the front end of the guide rail and the other end of the tension coil spring is fitted to one side of the slider. The tension coil spring thus exerts a tensile force on the slider which in turn pushes the staples forward on the guide rail.

1 Claim, 16 Drawing Figures

MINI-STAPLER

BACKGROUND OF THE INVENTION

Figure 14:
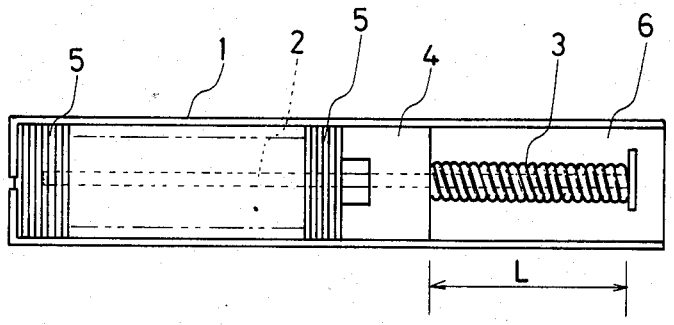
FIG.14 PRIOR ART

Conventional staplers have a compression or tension spring to push the staples forward. The basic construction with, for example, a stapler using a compression spring is a follows:

As shown in FIG. 14, there is a guide rod (2) within a frame (1), with a compression coil-spring (3) provided around the guide rod. This spring pushes the staple pushing member (4), which pushes the staples (5) forward.

However, with this type of construction, a certain amount of space (6) must be provided in the frame (1) to house the fully compressed spring (L), resulting in a relatively long frame.

Figure 15:
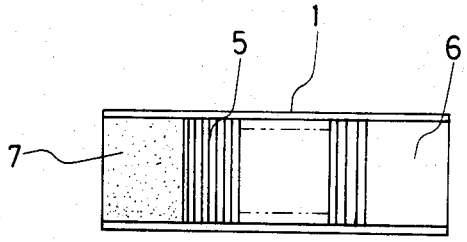
FIG.15 PRIOR ART

As an example of means to realize a more compact stapler, a type of stapler that has a magnet (7) instead of a coil spring to pull the staples forward was developed as shown in FIG. 15. With this type of stapler, space must be provided to house the magnet, but this was much less than the amount of empty space required for the spring, and enabled a considerable reduction in size.

However, the major problem with this type of stapler was that the staple stays inside the stapler (the magnet keeps it from going out) when accidentally pressed down without stapling through anything, which was quite difficult to remove.

PURPOSE OF THE INVENTION

The purpose of this invention is to provide a stapler in which the tension spring is brought around a member beneath the stapler, and in turn solve the problems that were inherent in conventional coil spring and magnetic staplers, for a more compact stapler.

SUMMARY OF THE INVENTION

To achieve the above purpose, one end of a tension spring is fixed to a staple pushing member that pushes the stables forward, the spring is brought around the front end of a frame and fixed to a pin that sticks out from the back of the frame. This type of construction provides for reversing of the direction of force at the end of the frame, and in turn causes the member to keep a constant force on the staples, pushing them forward each time a staple is discharged. Further explanation of the invention will be made using the drawings.

SIMPLE EXPLANATION OF DRAWINGS

Applications of this invention are shown in FIGS. 1–13.

Figure 1:
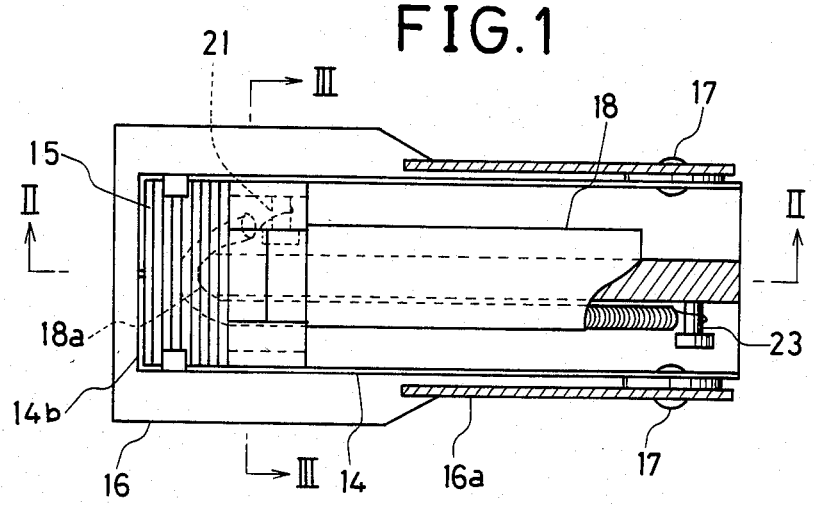

FIG. 1 Sectional plane view

Figure 2:
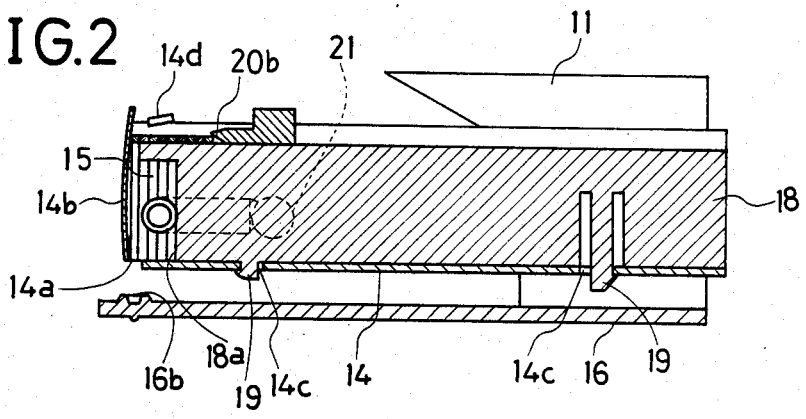

FIG. 2 Section II—II of FIG. 1

Figure 3:
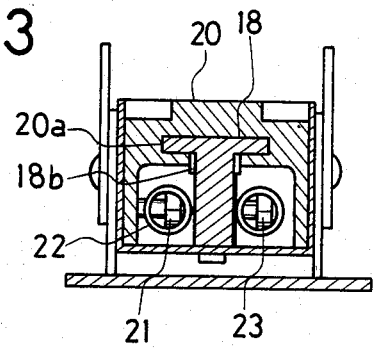

FIG. 3 Section III—III of FIG. 1

Figure 4:
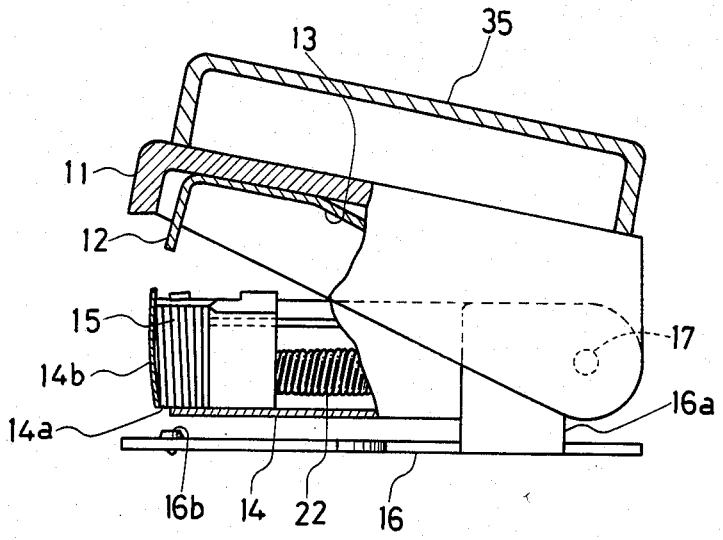

FIG. 4 Cutaway view

Figure 5:
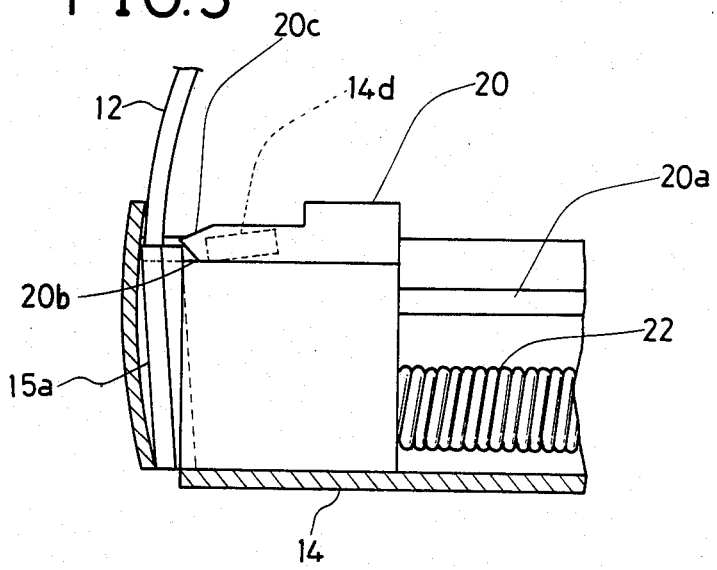

FIG. 5 Enlarged sectional view of front

Figure 6:
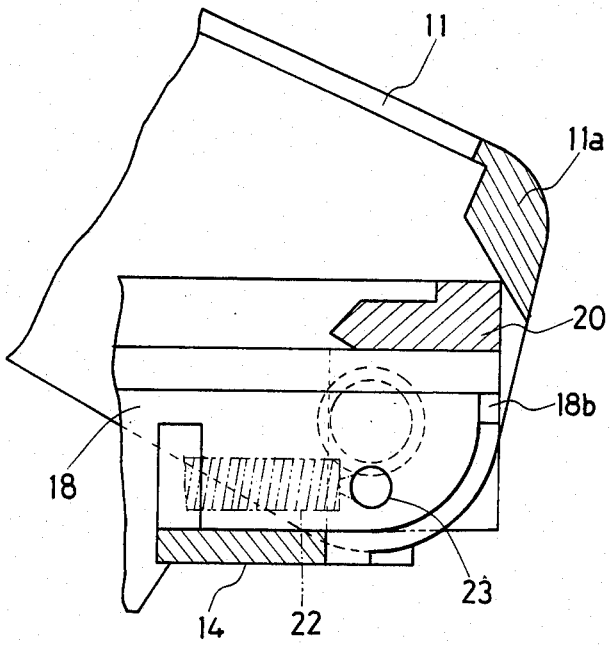

FIG. 6 Enlarged sectional view of back

Figure 7:
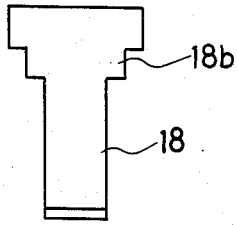

FIG. 7 Rail section

Figure 8:
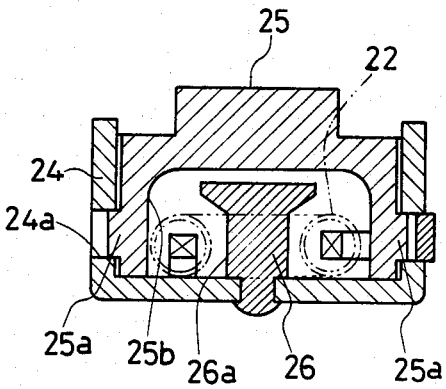
Figure 9:
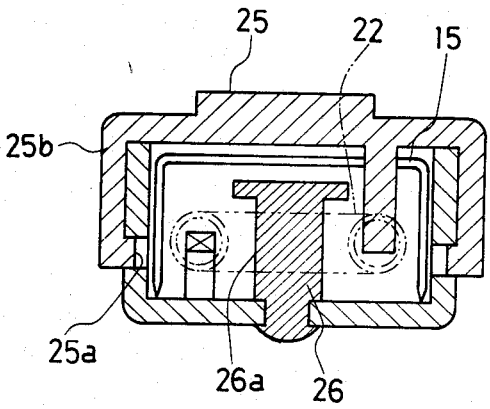
Figure 10:
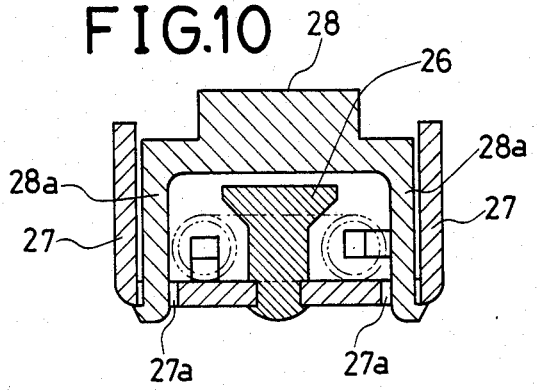

FIGS. 8–10 Respective side section views of actual applications

Figure 11A:
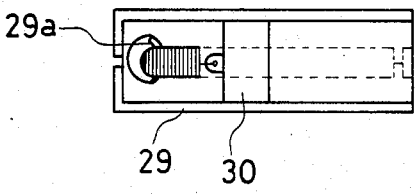
Figure 11B:
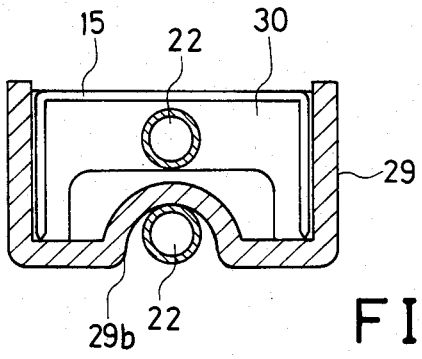
Figure 12:
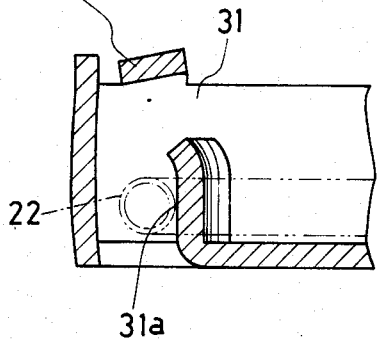
Figure 13:
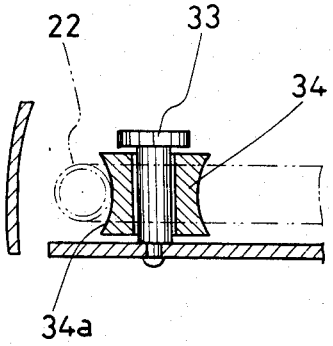

FIGS. 11 (*a*), (*b*) Bottom plan view and side section view of other applications FIGS. 12 and 13 Partial vertical section view of surface spring is brought around FIGS. 14 and 15 Plan views of conventional staplers In FIGS. 1 to 7, numeral 11 is a handle, which is provided with a tooth (12) at the front to push out the staples, and a plate return spring (13) in the rear. Provision is made in the channel shaped frame (14) for the staples (15) to move. A slot (14*a*) is provided at the front end of the frame (14) through which one staple (15*a*) at a time is ejected and there is a guide (14*b*) at the end of the frame for the tooth (12) which pushes out staples.

To make for a more compact stapler, the staple tooth (12) and staple tooth guide (14*b*) are provided with a circular arc. The outside of the staple tooth (12) moves up and down against the inside of the staple tooth guide (14*b*). Both sides of the base (16) are provided with a member (16*a*) through which a shaft (17) is horizontally passed, which joins the bases of the handle (11) and the frame (14), and allows them to swivel. The top of the front of the base (16) is provided with a staple bending anvil (16*b*) which corresponds to the said slot (14*a*).

A T-shaped rail (18) is provided in the center of the bottom of the frame (14), along its length. Two engaging members are provided as the bottom of the rail (18) which fit into the holes (14*c*) in the frame (14). The front engaging member (19) is first fit in the hole, and then the rear engaging member is pushed in. The elasticity of the rear engaging member holds the rail in the holes (14*c*). A gap is provided between the end of the rail (18) and the staple tooth guide (14*b*), and the front end of the rail (18*a*) is of a suitable shape for the spring to be brought around.

A staple pushing member (20) with an appropriate section is fit on top of the rail (18) in such a way that it can slide. That is, a T-shaped sliding groove (20*a*) is provided in the center of the staple pushing member of almost the same shape as the rail (18), which provides for sliding along the guide flange on top of the rail (18).

A projection (21) is provided on the inside of the staple pushing member (20), to which one end of the tension coil spring (22) is fitted. The tension coil spring (22) is brought around the surface (18*a*) at the end of the rail (18) and the other end is fitted to the projection (23) at the back of the rail (18). Since the tension coil spring (22) is fitted in the space below the staples (15), no additional space is required to house the tension coil spring (22).

The back of the guide rail (18) is provided with a wide section (18*b*) which engages the inside face of the slide groove in the staple pushing member (20). This wide section (18*b*) keeps the staple pushing member (20) in place when it is brought all the way back. The handle (11) is provided with a claw (11*a*) which releases the staple pushing member (20) from the wide section when the handle (11) is actuated.

The top of both sides of the front of the frame (14) is bent in to form staple retaining members (14*d*). The staple retaining members (14*d*) slant up towards the back to provide for easy loading of staples (15).

The top front of the staple pushing member (20) is provided with a retaining piece (20*b*) which is about half the width of the staples. This piece (20*b*) sticks out over the staples and the front of it is provided with a relief taper (20*c*).

This stapler is loaded in the same way as conventional staplers are: the handle (11) is opened, the staple pushing member (20) is pushed back towards the rear of the rail (18) and the staples (15) are loaded in the frame (14). When the staple pushing member (20) is pushed all the way back to the rear, it is held by the wide section (18*b*), providing for easy insertion of the staples. The retaining member (14*d*) and retaining piece (20*b*) prevent the staples from coming out. When the handle (11) is depressed after the staples have been loaded, the staple pushing member (20) is released from the wide section (18*b*), and the tension of the tension coil spring (22) causes the staple pushing member (20) to push the staples (15) forward.

When the staple (15*a*) at the front of the staples (15) is ejected (stapled), the staple pushing member (20) pushes them forward. One end of the tension coil spring (22) is fitted to the back of the rail (18). The spring is brought around the end of the frame (18*a*) and fitted to the staple pushing member (20). This creates a constant force acting on the staple pushing member (20) causing it to push the staples forward as each staple (15*a*) is forced out by the staple tooth (12).

Next, a different application will be explained. In FIG. 8, guide grooves (24*a*) are provided in the sides of the frame (24) as a means of guiding the staple pushing member (25). Projections (25*a*) are provided on both sides of the staple pushing member (25) so that it can move in the guide grooves (24*a*). The guide grooves (24*a*) are either punched or half blanked. The tension coil spring (22) is brought around the edge (26*a*) of a pillar shaped member (26) that is provided in the front end of the bottom of the frame (24). The pillar shaped portions (25*b*) of the staple pushing member (25) may be fit over the outside of the frame (24) as shown in FIG. 9.

In FIG. 10, guide grooves (27*a*) are provided in the bottom of the frame (27) as a means to guide the staple pushing member (28). The tips of the pillar shaped portions (28*a*) of the staple pushing member (28) are extended so that the staple pushing member can move in the guide grooves (27*a*). A single guide groove (27*a*) could also be provided in the center of the bottom of the frame (27).

In the application shown in FIG. 11 with grooves in the sides or bottom of the frame (29), one end of the tension coil spring (22) is fitted to the front center part of the staple pushing member and the spring is passed through a hole (29*a*) in the frame (29). It is guided back along a groove (29*b*) provided in the bottom along the length of the frame (29), and the other end of the spring is fitted to the back of the frame (29). In this application, the force of the tension coil spring (22) acts on the center of the staple pushing member (30) so that the staples (15) are pushed forward evenly.

FIG. 12 illustrates an application in which the surface which the spring is brought around, (31*a*), is formed by bending up a portion of the frame (31) by press. This eliminates the need for a separate part.

In FIG. 13, a shaft (33) is mounted to the frame and provided with a roller (34). The spring is brought around the outside of the roller (34*a*). This reduces the amount of the abrasion that the tension coil spring (22) is subjected to.

As is apparent from the above explanation, a considerable reduction in size was realized by bringing a tension coil spring around a member and back. This means was found to be much more effective than the previously invented means which used a magnet instead of a tension coil spring.

What is claimed is:

1. A mini stapler which comprises in combination (a) a handle having a tooth at a front end and a return spring at a back end, (b) a frame with a channel-shaped section that slidingly supports staples and a slot at a front end for staples to be ejected therefrom, (c) a base with a groove aligned with said slot and which bends the staples into an appropriate shape, (d) members at both sides of the back of the base to receive a back end of said frame, through which a shaft is passed to join the frame and base and provide for swivelling, (e) a staple pushing member and a guide means, said guide means comprising a T-shaped rail which is fixed along the bottom of and within said frame to permit the staple pushing member to slide thereon and, being of approximately the same shape as the section of a bridge and the staple pushing member being provided with a sliding groove to permit sliding on the guide means, (f) a tension coil spring which pushes the staples located in the frame via said staple pushing member, with one end of said tension coil spring attached to a portion of said staple pushing member adjacent said guide means and, (g) said spring passing around a front end of said guide means and having its other end attached to the back end of said frame.

* * * * *